US006916250B1

(12) United States Patent
Ricigliano

(10) Patent No.: US 6,916,250 B1
(45) Date of Patent: Jul. 12, 2005

(54) ENVIRONMENTALLY SIMULATED GOLF GAME

(76) Inventor: William Ricigliano, 4380 Eleventh Ave., SW, Naples, FL (US) 34116

( * ) Notice: Subject to any disclaimer, the term of this patent is extended or adjusted under 35 U.S.C. 154(b) by 0 days.

(21) Appl. No.: 10/764,701

(22) Filed: Jan. 26, 2004

(51) Int. Cl.[7] ..... A63R 69/36
(52) U.S. Cl. ..... 473/169; 473/157; 473/174
(58) Field of Search ..... 473/168–170

(56) References Cited

U.S. PATENT DOCUMENTS

| | | | | |
|---|---|---|---|---|
| 3,342,494 A | | 9/1967 | Talley, Jr. | 273/176 |
| 3,414,266 A | | 12/1968 | Mitchell | |
| 3,671,042 A | * | 6/1972 | Garber | 473/165 |
| 3,735,988 A | | 5/1973 | Palmer et al. | 273/178 |
| 3,843,136 A | | 10/1974 | Buenzle | 273/176 F |
| 3,885,795 A | | 5/1975 | Brewer | 273/176 |
| 4,743,026 A | | 5/1988 | Eady | 273/176 F |
| 4,934,704 A | | 6/1990 | Mazer | 273/176 |
| 5,203,566 A | | 4/1993 | Ricigliano | 273/176 |
| 5,419,561 A | | 5/1995 | Weber | 273/176 |
| 5,618,131 A | | 4/1997 | Weber | 404/32 |
| 6,367,797 B1 | | 4/2002 | McKenna-Cress et al. | 273/108.2 |

OTHER PUBLICATIONS www.tourturf.com "Tourturf Product", Jun. 2003, 2 page website.

www.golfturfs.com Golf Turfs of Texas, Jun. 2003, 2 page website.

www.fieldturfgolf.com "Field turf Golf/Landscaper Backyard Putting", Jun. 2003, 2 page website.

www.fieldturfgolf.com "Fieldturf Golf/Landscape Product Safest System", Jun. 2003, 2 page website.

www.golfandsportsturf.com "The Synthetic Turf That's Natural For Your Driving Range", Jun. 2003, 1 page website.

www.actiongreens.com "Action Greens", Jun. 2003, 8 page website.

* cited by examiner

*Primary Examiner*—Mark S. Graham
(74) *Attorney, Agent, or Firm*—Alfred M Walker

(57) ABSTRACT

An indoor miniature golf game is provided with a plurality of environmentally realistic simulated fairways and greens with an optional plurality of tee off positions. Sequential visual activity segments with intermediate target areas are provided on the fairways between the tees and the greens. Various materials both visually and physically simulate the accompanying landscape, so that the golf ball travels quickly over the greens, but is slowed down and caught by rough or water simulated areas. Further, the course is enhanced with simulations of actual scenery and real world playing conditions. Various configurations allow for customized play, which is proportional to the ability of the player.

8 Claims, 6 Drawing Sheets

ENVIRONMENTALLY SIMULATED GOLF GAME

FIELD OF THE INVENTION

The present invention relates to a miniature golf game with simulated environmental conditions and variable tee off positions.

DISCUSSION OF THE PRIOR ART

Various attempts have been made to design miniature golf courses which provide a playing field on a small scale, but these courses do not simulate the material of the terrain as a function of the speed and travel of the golf ball. Nor do these golf course games provide a means of testing visual acuity, such as is provided by the present invention with multiple tee-off positions and intermediate target zones which change in configuration. Further, the prior art does not attempt to reproduce actual scenery in a three dimensional physical manner. Lastly, the simulation of real world environmental conditions does not exist in the prior art.

Such prior art golf games are noted in U.S. Pat. No. 1,503,720 of Strasser, U.S. Pat. No. 1,591,095 of Meyer, U.S. Pat. No. 3,342,494 of Talley, U.S. Pat. No. 3,414,266 of Mitchell, U.S. Pat. No. 3,427,030 of Ward, U.S. Pat. No. 3,534,961 of Tiley, U.S. Pat. No. 3,604,710 of Jacobs, U.S. Pat. No. 3,649,027 of Vallas, U.S. Pat. No. 3,671,042 of Garber, U.S. Pat. No. 3,735,988 of Palmer, U.S. Pat. No. 3,843,126 of Buenzle, U.S. Pat. No. 3,885,795 of Brewer, U.S. Pat. No. 3,892,413 of Rotolo, U.S. Pat. No. 3,904,209 of Thomas, U.S. Pat. No. 4,019,748 of Healey, U.S. Pat. No. 4,673,183 of Trahan, U.S. Pat. No. 4,743,026 of Eady, U.S. Pat. No. 4,934,704 of Mazer, U.S. Pat. No. 5,419,561 of Weber, and U.S. Pat. No. 6,397,797 of McKenna-Cress. In addition, Applicant's prior U.S. Pat. No. 5,203,566 of Ricigliano describes a simulated golf course.

Additionally, TOUR TURF® is a gradated artificial turf construction including artificial fibers configured and placed to simulate grass. The fibers extend upward from an infill bed of sand and rubber particles simulating soil. The infill bed is held in place by an underlying porous textile mesh, which is located over layers of tight and open filled stones.

OBJECTS OF THE INVENTION

It is therefore an object of the present invention to provide a simulated golf course games which tests visual acuity with multiple tee-off positions and intermediate target zones which change in configuration.

It is also an object of the present invention to provide a simulated golf course game which reproduces actual scenery in a three dimensional physical manner.

It is yet another object of the present invention to simulate real world environmental conditions on a golf course.

SUMMARY OF THE INVENTION

In keeping with these objects and others which may become apparent, the plan of the course of the present invention may represent various locations and seasons around the world. It is suited for an indoor site of limited size as well as an outdoor regulation size course.

Typical golf rules may apply, such as scoring a bogey, that is, scoring a hole by scoring one stroke over par, or by scoring a birdie, that is by scoring a hole by scoring one stroke under par. Handicaps may be allotted to inexperienced players to increase the player's chance of winning with experienced players.

Such a course is scalable to the individual players' skill level. At times when the disparity is desired to be reduced or elimination, more skilled players are faced with greater obstacles or handicap.

For example, the degree of difficulty may be varied by provided alternative tee off positions. For example, a plurality of tee off position points, such as, for example, six tee off positions, may be provided on each tee off area with different orientations, such as straight level lie shots, uphill lie shots, downhill lies, off of hardpan surfaces, out of a sand trap, or with visual obstructions, such as trees or deep rough areas.

Alternatively, the tee off positions may be of varied design configurations, such as a series of concentric rings of varying diameters, where the player chooses in which concentric ring, and any area therein, from which to hit the ball to corresponding intermediate target areas with similar concentric rings.

As noted in Applicant's prior U.S. Pat. No. 5,203,566 of Ricigliano, the plan of the course may be easily constructed with varying carpet materials, which are selected to affect the movement and speed of the golf ball so as to simulate different playing conditions.

Although Ricigliano '566 uses carpet tufts to simulate golf course conditions, the present invention is intended to simulate the surface characteristics of the golf course, such as sand, water or gravel on the fairway by actual environmental and weather conditions. For example, a loose dusting of sand on the fairway up to the point of an actual sand trap can be utilized.

Shorter tufts, which are more densely placed, may be provided to simulate the grass of the fairways. Since the strands are shorter, they do not have the height to fully capture the balls and interrupt their travel. However the tufts will by virtue of their height and density slow down the movement of the golf ball. Furthermore, the carpet simulating the densely packed greens with the holes will be short and very densely packed, to allow the golf ball free movement without substantially slowing down the golf ball during putting on a green.

Similar to Ricigliano '566, plastic bushes and trees may be utilized as visual obstacles on the course. Taller strands of carpet tufts simulating the water, sand or rough hazards will by virtue of the height of the tufts and the density of the placement of the tufts, slow down and capture the ball, interrupting its movement, as occurs in a real golf game when the golf ball strikes water, sand or bushes in the rough.

However, unlike Ricigliano '566, in the present invention actual water or sand may be optionally utilized, in conjunction with simulated wind, sun, rain or other weather conditions.

Another feature of the invention is that the fairways are generally designed with angled dogleg configurations, so that a golfball has to be hit around a corner. To test the players visual acuity to land a golf ball at a particular elbow of a dogleg shaped fairway, intermediate target zone or scoring zones, generally circular, are provided. As a result, a player cannot by sheer force unsafely hit the golf ball through the dogleg by bouncing it against the terrain features, in contravention of typical golf ball travel flow.

By providing the intermediate target areas, the game requires the golf player to accurately land on the intermediate target area before proceeding to the green at the end of the fairway.

As also noted in Applicant's prior U.S. Pat. No. 5,203,566 of Ricigliano, to increase variety and to simulate differing lengths of fairways in real life, the diameter of each circular intermediate target area may vary in proportion to the length which the intermediate target area is located away from the tee at the beginning of each fairway. For example, if the intermediate target area is 22 feet from the tee, then the diameter of the intermediate target area is a fairly large 22 inches in diameter. On the other hand, if the intermediate target area is only 8 feet from the tee, then the intermediate target area is only 8 inches in diameter.

However, unlike Ricigliano '566, additionally the simulated golf course may be provided with intermediate target areas of concentric rings of ascending size, so that the player has to land on a similar concentric ring in an intermediate target area.

DESCRIPTION OF THE DRAWINGS

Other characteristics and advantages of the invention will become more apparent from the following description of the drawings, in which.

DESCRIPTION OF THE PREFERRED EMBODIMENT

Figure 1:
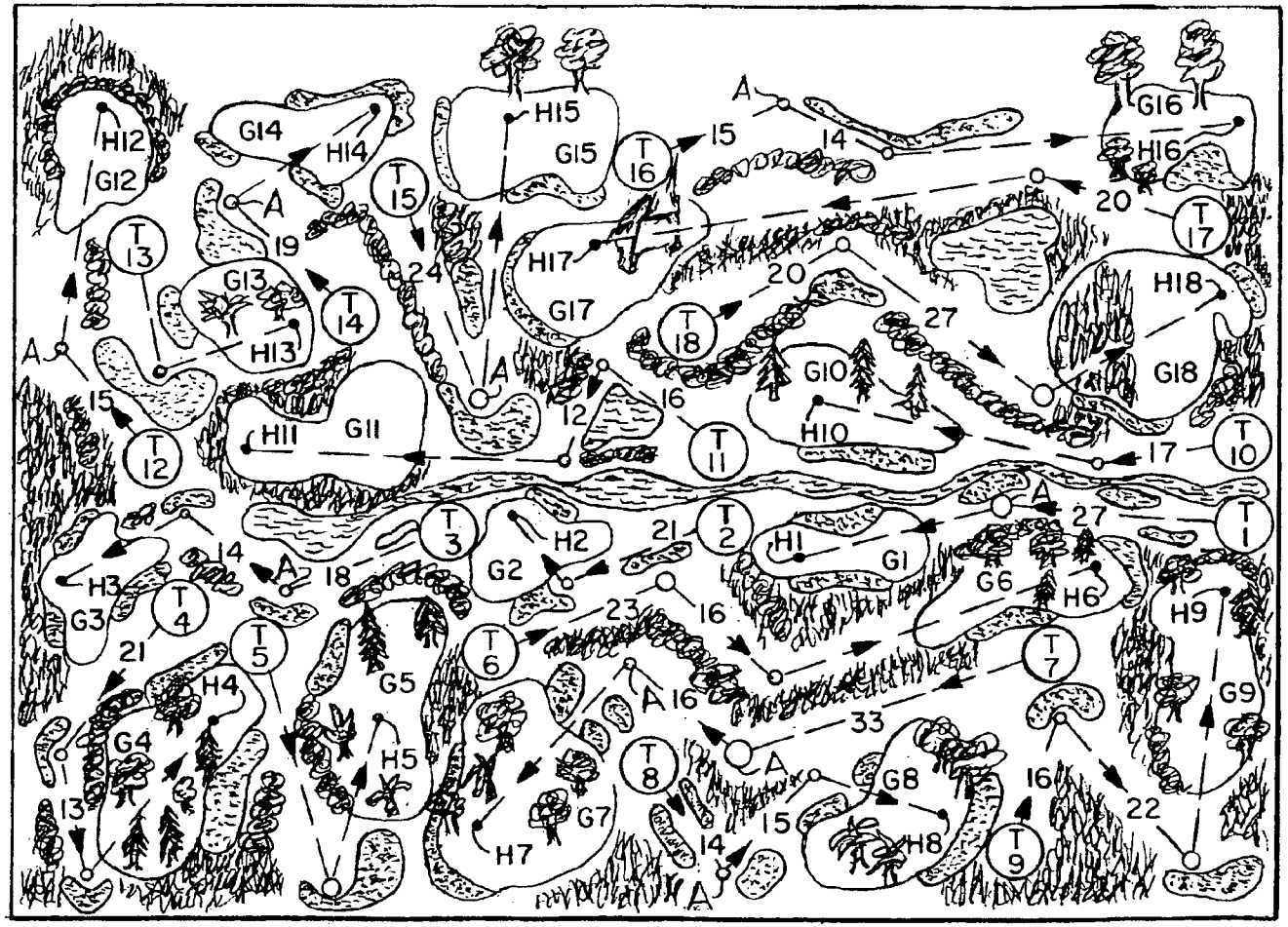
FIG. 1 is a simulated golf course with artificial environmental terrain and vegetation.
Figure 6:
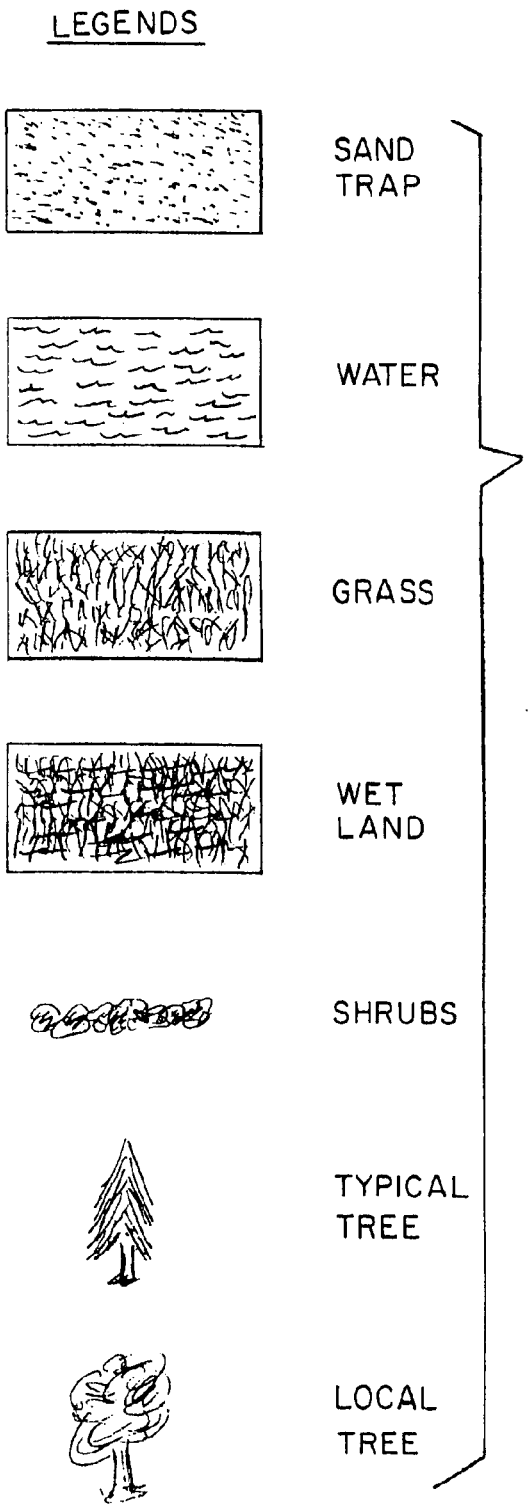
FIG. 6 is a legend diagram for the artificial vegetation of the embodiments for simulated golf courses shown in FIGS. 1–4; and, FIG. 7 is a crossectional view of a prior art turf section, shown with the new drainage arrangement depicted in of FIGS. 4 and 5.
Figure 7:
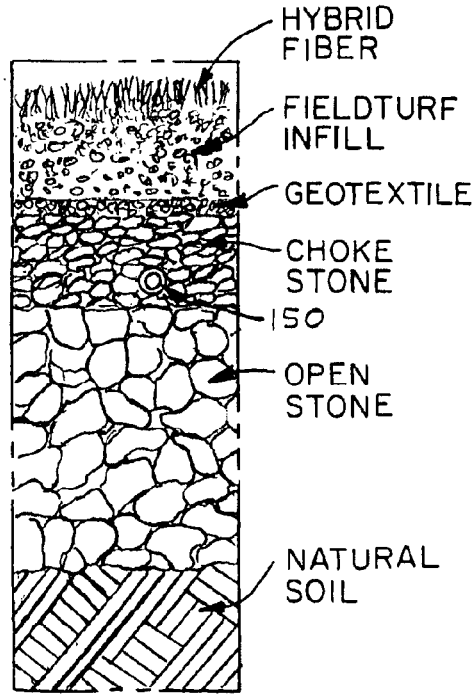

Referring now to FIGS. 1 and 6, the simulated course game comprises a series of carpeted miniature tees T1 to T18 connected by fairways to greens G1 through G18, with holes H1 through H18, which can be interspersed by simulated water hazards, sand hazards and rough hazards.

As shown in FIG. 6, the graphic legends therein depict sand traps, water hazards, thick grass, wetlands, shrubs, typical evergreen trees and typical local trees appropriate for the course being simulated in the golf course shown in FIG. 1.

For example, a temperate climate course would have local leafy deciduous trees, but a warmer southern climate course could have local cypress or palm trees.

As noted in FIG. 1, the artificial physical representations of the scenery and landmarks are intended to give the player the feel of playing at notable courses. For example, a simulation of Pebble Beach in California can be accomplished by simulating the scenery of the course. Notable brush, trees, sand traps, rock, mountains, boulders and water hazards can be strategically placed to resemble the actual golf course. These artificial physical representations of sceneries and landmarks are 3 dimensional real world replicas of the actual plants, trees, rocks, boulders, mountains, bodies of water, etc. These objects can be made with any materials including artificial silk, lichen, wood, plastic, vinyl, stone or metal. The sized of these objects can be varied to be proportional to the course. Much of the artificial vegetation can be purchased commercially.

Additionally, the artificial physical representations of scenery and landmarks can be utilized to represent a desired environment for golfing. A section of the simulated golf course can resemble a desert, thus allowing a player to play through the Gobi Desert.

The same can be accomplished for areas such as swampland, rain forest, or even replicas of certain cities.

Also in one embodiment of the simulated golf course, each hole can represent a certain famous golf course. In one embodiment, a person can play on a course, which resembles Pebble Beach to any famous PGA golf course. Alternatively, the simulated golf course may contain holes representative of different continents of the world. Thus a person can start with hole one being evocative of United States, then advance to hole two with traits of Scotland and so on. The elements, which distinguish the holes, can be in landmarks such as famous buildings, structures, or the environment associated with those courses. For example, a course representative of Scotland, may utilize fog machines to simulate the look and feel of an actual course in Scotland. Also a course simulating England, may have a replica of Stone Hedge, or Big Ben.

Figure 2:
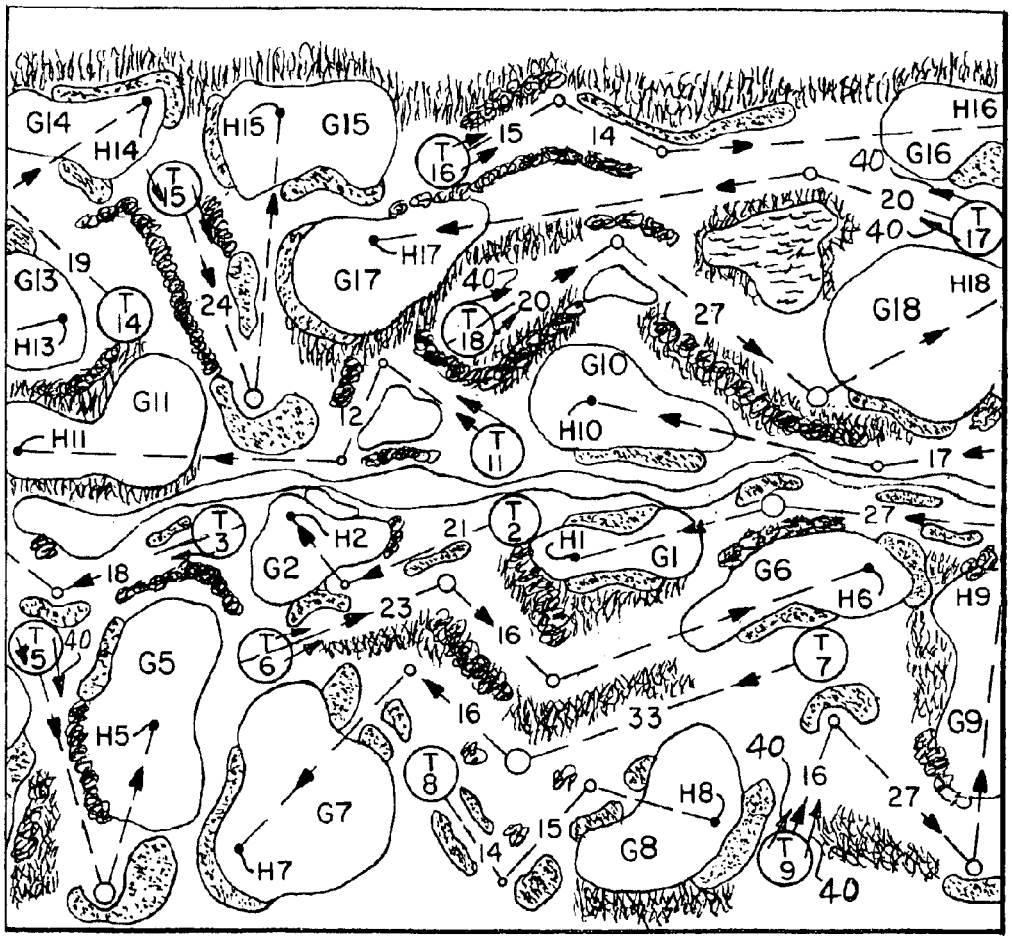
FIG. 2 is an alternate embodiment for a simulated golf course with multiple varied tee placements.

As noted in FIG. 2, the represents an alternate embodiment for the simulated golf course with multiple tee positions 40 about any tees T1, T2, T3, etc., up to the final tee such as for example T18. This is a typical arrangement, which can be applied, to one or more, or all, tee off points.

For example, there may be six tee off positions for hitting the golf ball, such as from a straight lie, an uphill lie, a downhill lie, out of a sand trap, to the right or left or from behind a visual obstruction, such as a tree.

Each hole can be aimed at from a multiple of tee positions 40 shown by the typical directional arrows indicating the direction of the ball movement toward the desired target. The current state of golfing usually consists of one tee per hole. The multiple tee positions 40 are designed to accommodate players with different athletic abilities or ages. Weak, inexperienced, or handicapped players can tee off at tee with less impedances, more favorable angles or are closer to the hole. The varied tee positions allow each player to compete on a more equal basis.

Although facilities may differ in design because of site and acreage, a typical site is on an area of from one quarter to approximately 9 acres. The tee areas 40 shown in FIG. 2 may optionally be color-coordinated. These might differ from an actual tee off, portion but it shows how one example of multiple tee off positions are played.

A player or players can go to the control desk or starter to play a round of golf. He/she can either play where they want, from any tee position they choose, or they can have a computer choose the course configuration for them. If the simulated golf course uses six different tee positions at each hole, the possibilities will be 6 to the $9^{th}$ power, or 10,077,696 different course configurations available.

In this embodiment each hole has different tee placements (in this case six). Every tee placements has a numbered degree of difficulty (numbers 1–6, one being the easiest, 6 being the toughest). This gives the player six different levels of play that they can play at a time.

| | Average |
|---|---|
| Level 1 | 1.0–1.5 |
| Level 2 | 1.5–2.5 |
| Level 3 | 2.5–3.5 |
| Level 4 | 3.5–4.5 |
| Level 5 | 4.5–5.5 |
| Level 6 | 5.5–6.0 |

If a player wants to play a Level 3 course, a computer with software will produce a scorecard that averages between a 2.5 and 3.5 for that course, with the following output data:

| Hole | 1 | 2 | 3 | 4 | 5 | 6 | 7 | 8 | 9 | Score |
|---|---|---|---|---|---|---|---|---|---|---|
| Tee Placement | 2 | 5 | 1 | 1 | 4 | 3 | 3 | 6 | 2 | 27 |
| Tee Placement | 4 | 1 | 2 | 2 | 6 | 5 | 4 | 3 | 4 | 31 |

The first score or level is 27 divided by 9 holes or a 3.0. The second is 31 divided by 9 holes or a 3.44. Both are within the Level 3 play. The same goes for all other levels of play. A player can choose the degree of difficulty he/she wants to play at, or may choose to play where they want by choosing the course himself or herself.

The user can also handicap the scoring system by deducting strokes for the degree of difficulty being played. A course with all number "one" tee positions would be at a "one" handicap. A course playing at a 4.2 level would be at a 4.2 handicap or 4.2 strokes deducted from a score in a tournament situation, if people would be competing against one another.

| | Level of Play | Actual Score | Handicap | Net Score |
|---|---|---|---|---|
| Player 1 | 2.8 | 34 | 2.8 | 31.2 |
| Player 2 | 3.5 | 31 | 3.5 | 27.5 |
| Player 3 | 4.2 | 32 | 4.2 | 27.8 |
| Player 4 | 5.1 | 33 | 5.1 | 27.9 |

In the above game, Player 2 would win with a 27.5 score.

Although holes may be on a miniature scale of about 10 to 30 yards in length, in an alternate embodiment typical "pitch and putt" hole lengths of from 60 to 105 yards may be provided. An example of such a pitch and putt course having tees with six color-coordinated tee-off positions 40 is as follows:

Hole #1
100 Yards
30 yards from Tee #1 on right side of the fairway is a tree.

| Tee | | |
|---|---|---|
| #1 | Blue | Straight Level Shot |
| #2 | Red | Uphill Shot 105 Yards From Green |
| #3 | Green | Downhill Right Lie |
| #4 | Orange | On a Hardpan Surface |
| #5 | Purple | Downhill Left Lie |
| #6 | Brown | Downhill Steep and Straight |

Hole #2
80 Yards
Sandtrap is 75 yards from the green and 5 yards to the left of Tee #1

| Tee | | |
|---|---|---|
| #1 | Blue | Straight Level Shot |
| #2 | Red | Downhill Right Lie |
| #3 | Green | Downhill Straight Lie |
| #4 | Orange | On a Hardpan Surface |
| #5 | Purple | Left Downhill Lie |
| #6 | Brown | Out of the Sandtrap |

Hole #3
90 Yards
2 Trees located symmetrically 15–20 yards from an open tunnel towards the green.

| Tee | | |
|---|---|---|
| #1 | Blue | Straight Level Shot |
| #2 | Red | Uphill Shot 95 Yards From Green |
| #3 | Green | Out of the Sand, 80 Yards From Green |
| #4 | Orange | Downhill Lie 95 Yards From Green |
| #5 | Purple | Uphill Lie With Tree Obstruction in Line |
| #6 | Brown | Straight Lie With Tree Obstruction in Line |

Hole #4
70 Yards
Indian hills surround the front of the green 15 yards from the front edge. A tree with no undergrowth is situated 25 yards from Tee #1 along the left side of fairway.

| Tee | | |
|---|---|---|
| #1 | Blue | Straight Level Shot |
| #2 | Red | Uphill Lie 75 Yards From the Green |
| #3 | Green | Downhill Lie 65 Yards From Green |
| #4 | Orange | On a Hardpan Surface |
| #5 | Purple | Out of the Sand |
| #6 | Brown | Off of a Hardpan Surface With Obstructed View From Tree |

Hole #5
60 Yards

| Tee | | |
|---|---|---|
| #1 | Blue | Straight Lie |
| #2 | Red | Uphill 55 Yards From Green |
| #3 | Green | Left Downhill Lie |
| #4 | Orange | Downhill Straight Lie |
| #5 | Purple | Off a Hardpan Surface 10 Yards to the Left of # Tee #1 |
| #6 | Brown | Downhill Right Lie |

Hole #6
95 Yards
There was a tree 25 yards along the right side of the fairway.
On the right side area 15 yards from the front edge of green is a hardpan surface.
On the left side area 15 yards from the front edge of green is a deep rough.

| Tee | | |
|---|---|---|
| #1 | Blue | Straight Lie |
| #2 | Red | Downhill Left Lie |
| #3 | Green | On a Hardpan Surface 10 Yards From Left Tee # |
| #4 | Orange | Straight Downhill Lie |
| #5 | Purple | Downhill Right Lie |
| #6 | Brown | Out of the Sand, 105 Yards From Tee #1 |

Hole #7
40 Yards

| Tee | | |
|---|---|---|
| #1 | Blue | Straight Lie |
| #2 | Red | Uphill Lie 45 Yards |
| #3 | Green | Downhill Straight Lie 35 Yards From Green |
| #4 | Orange | Out of the Sand, 35 Yards From Green |
| #5 | Purple | Downhill Right Lie |
| #6 | Brown | Downhill Right Lie on Hardpan |

Hole #8
50 Yards

| Tee | | |
|---|---|---|
| #1 | Blue | Straight Lie |
| #2 | Red | Downhill Lie |
| #3 | Green | Uphill on a Hardpan Surface, 45 Yards From Green |
| #4 | Orange | Right Downhill Lie |
| #5 | Purple | Out of a Deep Sand, 60 Yards From Green |
| #6 | Brown | Downhill Lie Hardpan Surface 45 Yards From Green and Directly Behind Water |

Hole #9
105 Yards
There is a tree 25 yards from Tee #1 along the left side of fairway.

| Tee | | |
|---|---|---|
| #1 | Blue | Straight Lie |
| #2 | Red | Uphill Lie 100 Yards From Green |
| #3 | Green | Downhill Right Lie |
| #4 | Orange | Downhill Left Lie |
| #5 | Purple | Straight Lie With Obstructed View With Tree |
| #6 | Brown | Hardpan Surface 100 Yards From Tee #1 With Obstructed View of Tree |

Certain tee positions 40 can be positioned closer to the hole such that the total distance to the hole is minimized. The physical distance between the tee position 40 and hole can staggered amongst the different tee positions. Thus less stamina and overall physical strength is required with the tees that are closer to the hole. This would also reduce the ancillary fatigue associated with walking the course while carrying the equipment.

Varied tee positions 40 can further include a deferential in tee height. The longitudinal length of the tee position 40 can increase to aid in the ease of the swing. A larger tee height facilitates a greater under swing allowing more control for inexperienced players. Additionally, the higher tee height can aid the player immensely depending on the type of turf played. If there was a simulation of tall grass, the player would be more able to address the ball with a taller tee.

Tee positions 40 can be placed whereas the angle is essentially a straight line to the hole. Alternatively the angles may be reduced lowering the total minimum swings to reach the hole. Thus, certain tee positions 40 can be positioned such that the minimum of four perfect swings is required to get the ball into the hole compared to just two. Further, a position 40 where the tee is completely in the line of sight from the tee position 40 would aid the player psychologically as well as physical distance.

Tee positions 40 can also be positioned such that physical objects or sight obstacles are reduced or removed. For example, a tee position 40 can be position that the danger of a sandtrap is reduced. This can be achieved by removing sight obstacles like the artificial trees, bushes, or hills.

Figure 3:
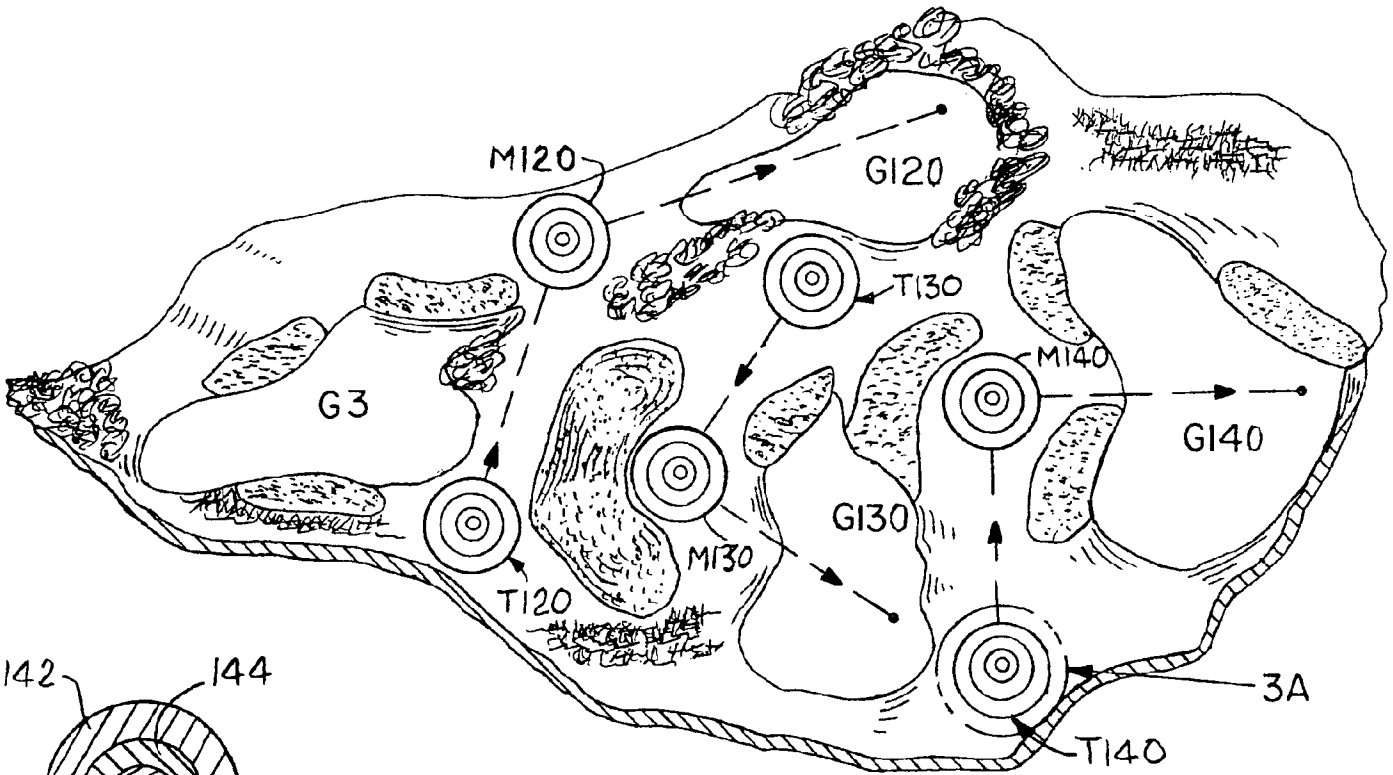
FIG. 3 is a detail view of an alternate embodiment for a simulated golf course with concentric tee off and intermediate zones of varying difficulty.

As noted in FIG. 3, in another embodiment for varying tee positions, there are shown tees T120, T130 and T140 and intermediate target areas M120, M130, M140. Each tee T120, T130, T140 and each intermediate target areas M120, M130, M140 have a plurality of circular concentric rings of ascending diameter size.

Figure 3A:
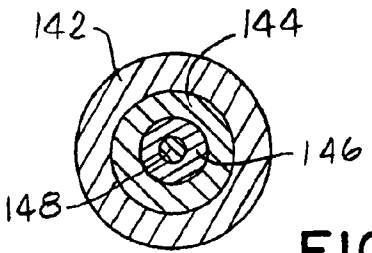
FIG. 3A is a close-up view of one of the concentric zones of FIG. 3.

For example, FIG. 3A is a typical representation showing rings 142, 143, 146 and 148 of progressively smaller diameters. When teeing off, the user selects a position within any of rings 142, 144, 146 or 148, as opposed to selecting specified tee off positions 40 shown in FIG. 2. The user then can also choose correspondingly typical rings 142, 144, 146 or 148 in respective intermediate zones M120, M130 or M140.

For example, the user can choose to play from anywhere in outer concentric ring 142. Alternatively, the user's ball placement choice is limited if the user chooses inner circular area 148. Optionally, the user can be required to land the ball in the same corresponding ring 142, 144, 146 or 148 in respective corresponding intermediate areas M120, M130 or M140, each having concentric rings similar to concentric rings 142, 144, 146 or 148.

As also shown in FIG. 3, there may be multiple intermediate concentric target rings 142, 144, 146, 148 of intermediate concentric ring areas 120, 130, 140, etc. Intermediate targets are larger to accommodate for more inexperienced, handicapped, less powerful players. Color or boundary circles, etc can distinguish the graduations of the smaller concentric intermediate target rings 144, 146 or 148. Selective intermediate targets 142, 144, 146, 148 can be assigned beforehand at the start of the game. Nevertheless, intermediate targets 142, 144, 146, 148 may be adjustable during play for each particular player. One purpose of the intermediates is to have different people with different abilities to play on similar levels.

Also, rules are promulgated such that a person who lands directly upon their intermediate target area M120, M13, M140, etc., from respective tees T120, T130, T140 is entitled to have one stroke subtracted from the score of play of the simulated golf game. This presents a further incentive for the player to accurately hit the ball to the intermediate target area M120, M130 or M140, without trying to hit the ball through the doglegs in an overly brisk manner to greens G120, G130, G140 in an unnatural, careening travel of the ball, which does not simulate the incremental hitting of the ball in real play of a full size golf course from a tee to an elbow of a full length doglegged fairway.

Likewise, as also noted in Ricigliano '566, in an alternate embodiment balls can be hit to the intermediate areas A of FIG. 1, the area of which is proportional to the distance from the respective tee. For example, where intermediate target area A is only 14 feet from tee T8, therefore intermediate target area 18 is only 14 inches in diameter. Since intermediate target area A associated with tee T8 is small, its distance from tee T8 is proportionally smaller than the longer distance of larger intermediate target area A is from tee T1. Thus each circular intermediate target area has a predetermined ratio of a sized diameter directly proportional to a predetermined sized distance of said circular intermediate target area from the tee of its respective said fairway. The ratio of said sized diameter of each said circular intermediate target areas A to the respective said distance of said circular intermediate target area A from its tee is identical to each ratio for each other of the sized diameter of each other circular intermediate target areas A to each other of their respective distances of circular intermediate target areas A from each of their respective tees.

It is also to be noted that the final target greens contains holes for the golf balls. For example, green G1 contains hole H1 into which the golf balls are hit into for the play for that particular hole H1.

Also, rules are promulgated such that a person who lands directly upon intermediate target area from a tee is entitled to have one stroke subtracted from the score of play of the simulated golf game. This presents a further incentive for the player to accurately hit the ball to the intermediate target area, without trying to hit the ball through the dogleg of fairway in an overly brisk manner to a green in an unnatural, careening travel of the ball to a tee, which does not simulate the incremental hitting of the ball in real play of a full size golf course from a tee to an elbow of a full length doglegged fairway.

As shown in FIGS. 4–7 the golf course of the present invention may be provided with simulations of actual environmental weather conditions of play.

Figure 4:
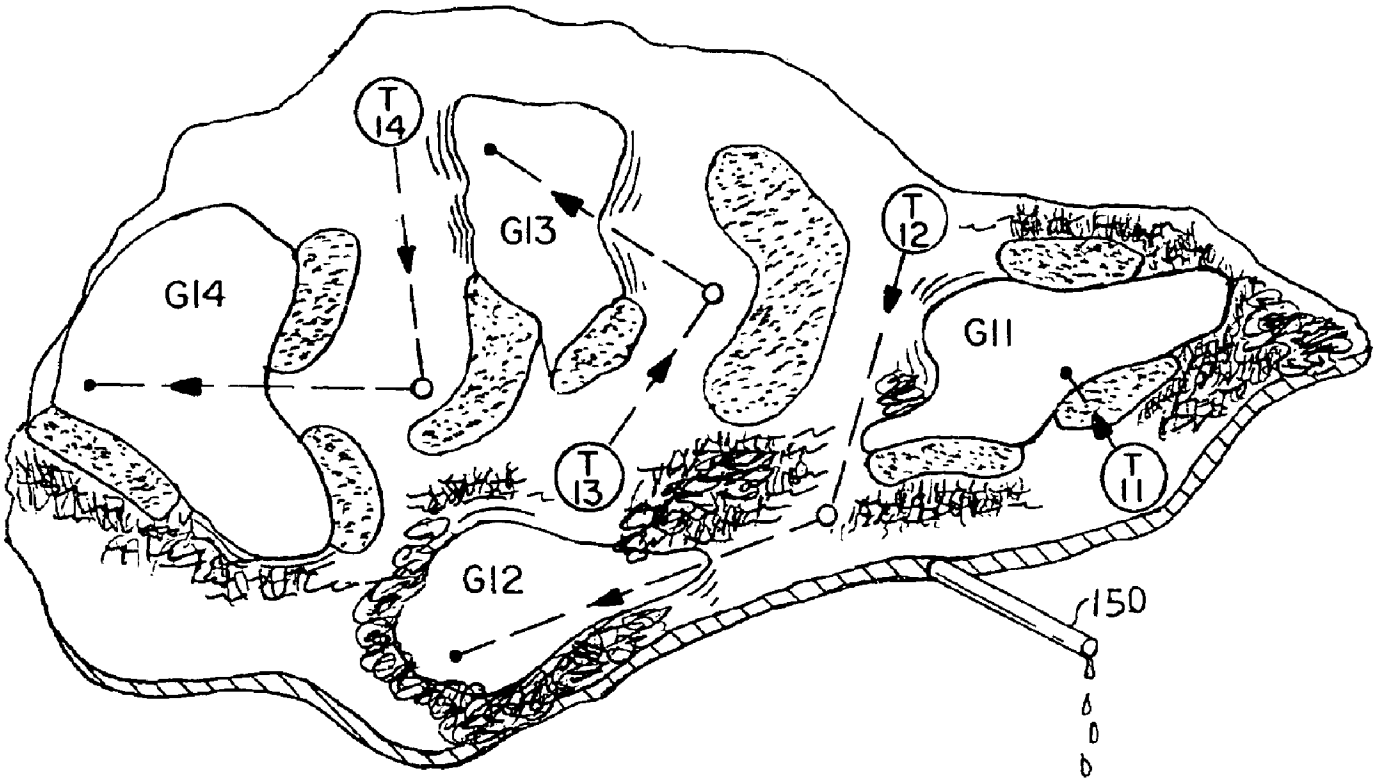
FIG. 4 is a typical drainage arrangement of a portion of a simulated golf course for temporary infusion of water to simulate soggy conditions.

For example, FIG. 4 is a cross section view of the golf course with a drainage system 150. Certain areas of the course may be saturated with water to enhance the difficulty of play. The use of water can simulate play in the early morning, or after a storm. The wet course may have a detrimental effect on a person's swing and accuracy of the ball. This part of the course may be utilized for someone to practice their swing in wet conditions. Water can be deposited on top of the ground or alternatively it can be pumped in. Elaborate irrigation systems may be utilized to achieve water saturation. Furthermore, a drainage system 150 may be set up to remove water when desired. Drainage can be accomplished with drainage system 150 through the forces of gravity or added with a pressurized system. Alternatively, heat can also be utilized to further the drying of the course. These pumps, heaters and irrigation systems can be easily found in the current state of the art.

Figure 5:
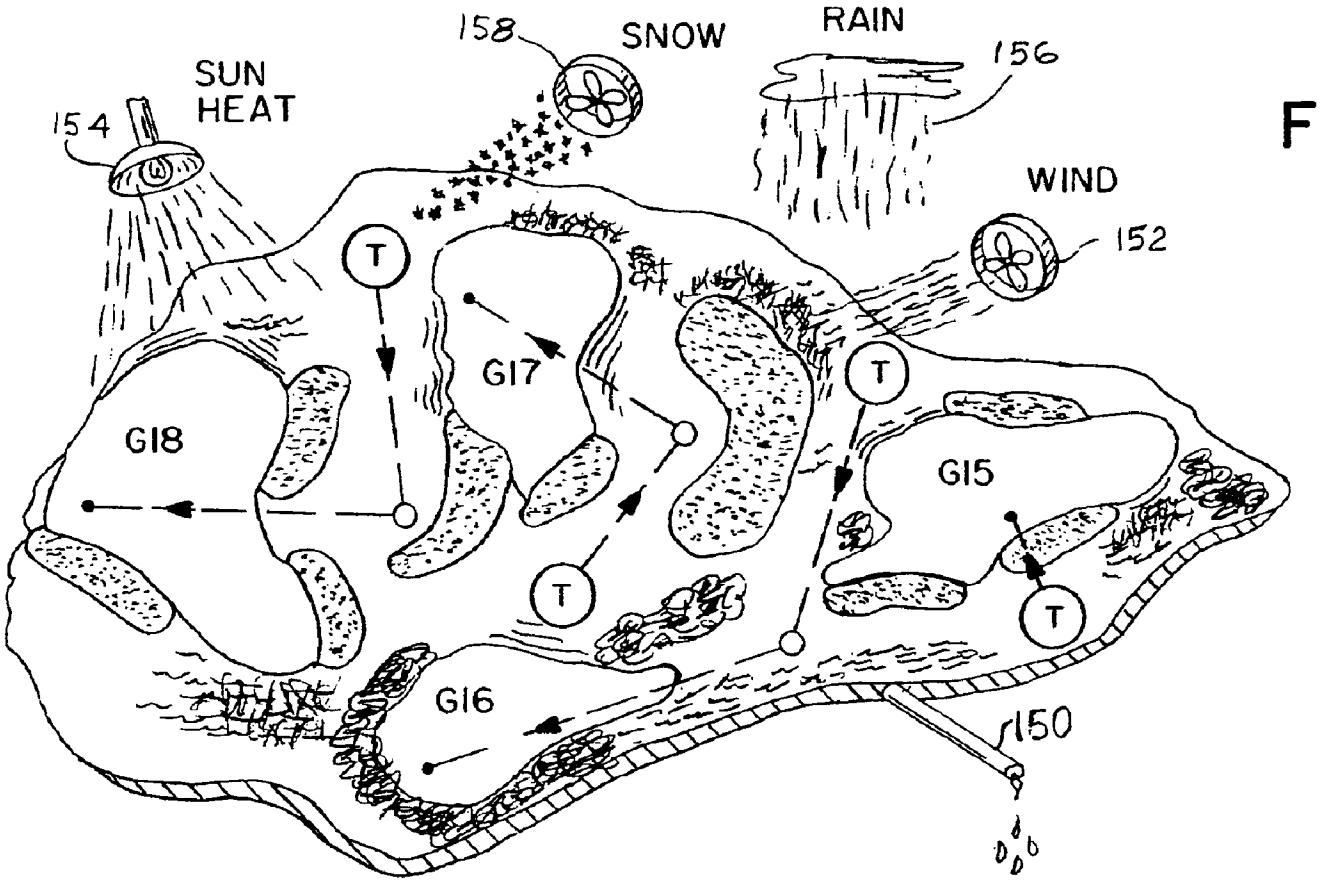
FIG. 5 shows a diagrammatic view for simulating varying sunlight, wind, rain, snow and other weather conditions.

FIG. 5 shows views of the golf course with environmental and weather effects. Environmental effects can be accomplished with tools and machines, which are currently available.

Wind conditions on the course can be facilitated through an elaborate fan system 152, strategically placed to control the wind direction. The wind effects would be used to hinder the players and increase the challenge of the course. Wind can affect the fly or roll of the golf ball.

Fog can also be created using fog machines (not shown) arranged in a predetermined configuration. The fog can be used as a visual obstacle. The intensity of the fog can be predetermined from having visual problems in the line of sight of the hole to hindering the actual addressing of the ball.

Lighting conditions may also be controlled to simulate certain times of the day. Illuminating lamps 154 can be utilized to control the amount of light on the course. As players play on each successive course, the direction and intensity of lighting may be changed to reflect the time elapse as if they where playing on a regulation course over the course of a day time.

Rain can range from a light mist to a downpour. Sprayers 156 can be arranged so that mist can be applied to the field. Of course the volume of water can be adjusted to account for the intensity of the rain. Rain is another element that can be a visual obstruction to the player. To remove the water, drainage system 150 is utilized.

Artificial snow can also be utilized on the course. Snow would be used to inhibit sight and hinder the natural golf swing. A snow effect may be accomplished through the use of blowers 158 projecting white particles. Such particles can be snow, ice, plastic, foam, paper, or any combination thereof.

The description of the golf course tuff composition is incorporated by reference as described in Ricigliano '566. Various tufts of carpet, which simulate various terrain and function to slow down or accelerate the travel of the golf ball. Carpet tufts of green G1 with a low rolling resistance, by virtue of the densely packed, short tufts. Fairways are depicted with higher, but less densely packed tufts to generally allow free movement of the golf ball. Furthermore sand hazards may be constituted from taller, looser tufts spaced farther apart to interrupt the travel of the ball and retard its movement, capturing it as a retention means, such as how a sandtrap interrupts the travel of a golf ball. Alternatively, sand traps may include actual sand.

The carpeted surfaces may be pile fabric such as indoor-outdoor carpeting with short, densely packed tufts of carpeting for greens G1 through G18 inclusive, where appropriate. The smooth surface of the indoor-outdoor carpeting will provide little friction to slow down the golf ball upon simulated green G1. On the contrary, normal household everyday use carpeting may be provided for fairways, to generally permit smooth travel of the golf ball, while applying a significant amount of friction to slow down the golfball as it travels toward intermediate target areas, or from intermediate target areas toward greens G1 through G18 inclusive, having holes H1 through H18 inclusive. Finally, hazards such as sand hazards or water hazards may be constituted from very plush carpeting with tall tuft strands which are loosely spread apart to act as a retention means to physically slow down and capture the golfballs, as water and sand hazards do in real life.

As noted in Ricigliano '566 capturing of the ball in hazards will be attained by slackening the speed of the ball from the increased friction of the tall loose tuft strands of the hazards upon the golf ball, since the taller, looser tufts of carpeting will slacken the travel of the ball, and urging the tufts themselves against and around the golf ball. The looseness of the tuft strands of the hazards partially form depressed cavities into which the bottoms of the golf balls travel, exerting pressure upon the golf balls to capture them, simulating the capturing of a golf ball within a real water hazard or real sand trap. As the golf balls further travel slowly within the hazards they are retained until stopped from motion by the pressure of the tall loosely packed tufts upon the ball. It is noted that the collection of tall strands in the simulated hazards begin to mesh and converge together in front of the ball traveling laterally against the tall tuft strands, as the advancing golf ball comes in contact with the plurality of tall tuft strands in front of it.

For safety reasons, no airborne strokes of the golf ball are permitted. The circular intermediate target areas comprise the simulated miniature golf course a plurality of visually distinguishable scoring zones of different values, with the different valued scoring zones corresponding to a reduction of a score of a player by a scoring stroke when a golf ball lands on one of the plurality of visually distinguishable scoring zones. Because of the fact that a player subtracts a stroke if the player hits the golf ball to one of the proportionately sized circular intermediate target areas, there is an incentive to safely and accurately hit the ball only upon the surfaces of the fairways from the tees T1–T18 to intermediate target areas.

The size of the entire golf course may vary from the size of a regulation golf course to one that is capable of being housed indoors.

Any novel combination of elements from FIG. 1 to FIG. 7 may be utilized in the simulated golf course.

While the above invention has been described with reference to certain preferred embodiments, the scope of the present invention is not limited to these embodiments. One now skilled in the art may find variations of these preferred embodiments which, neverthless, fall within the spirit of the present invention, whose scope is defined by the claims set forth below.

What is claimed is:

1. A simulated golf course comprising:

a plurality of fairways with tees and holes for golf balls, said fairways having angled dogleg configurations;

each fairway having a tee-area, a hole and a target area at an elbow of the fairway made up of concentric circular intermediate target areas;

each said concentric circular intermediate target area having a predetermined ratio of a sized diameter directly proportional to a distance from a tee of its respective fairway;

a size of each said concentric circular intermediate target area adapted to be utilized for a skill and ability of an individual player;

each tee-area comprised of concentric rings varying diameters, containing a tee, said rings corresponding with the concentric circular intermediate target areas in order to aid players with higher handicaps; and each hole being configured to represent a different world location.

2. The simulated golf course of claim 1 in which the different world location is a famous golf course.

3. The simulated golf course of claim 2 in which said fairways have artificial representations of scenery and landmarks.

4. The simulated golf course of claim 1 in which said fairways have simulated environmental effects such as wind, rain, snow, and lighting.

5. The simulated golf course of claim 4 in which said fairways are designed to being capable of being satiated with liquid followed by removal of said liquid.

6. The simulated golf course of claim 5 in which said fairways have portions with deposited particles.

7. The method of making an indoor golf course comprising the steps of:

forming indoors a plurality of fairways with tees and holes for golf balls, said fairways having angled dogleg configurations;

constructing each fairway so that each fairway will have a tee-area, hole and a target area at an elbow of the fairway, said target area being made up of concentric circular intermediate target areas;

forming each of the concentric circular intermediate target areas to have a predetermined ratio of a sized diameter directly proportional to a distance from a tee in its respective fairway, a size of each concentric target area being adapted to be utilized for individual skill and ability of an individual player;

forming each tee-area into concentric rings of varying diameters for the placement of a tee in each concentric ring of the tee-area, the location of the tees corresponding with the concentric circular intermediate target areas in order to aid players with higher handicaps; and configuring each hole to represent a famous golf course.

8. The method of claim 7 in which said golf course is configured to simulate environmental conditions including satiation with water for providing play of a golf course which is water satiated.

* * * * *